US005081006A

United States Patent [19]

Tanaka et al.

[11] Patent Number: 5,081,006

[45] Date of Patent: Jan. 14, 1992

[54] SILVER HALIDE PHOTOGRAPHIC LIGHT-SENSITIVE MATERIAL AND METHOD OF FORMING COLOR IMAGE

[75] Inventors: Shigeo Tanaka, Tachikawa; Masahiro Shibuya, Okawara, both of Japan

[73] Assignee: Konica Corporation, Tokyo, Japan

[21] Appl. No.: 577,734

[22] Filed: Sep. 5, 1990

[30] Foreign Application Priority Data

Sep. 15, 1989 [JP] Japan ..... 1-240454

[51] Int. Cl.[5] ..... G03C 1/16; G03C 7/34

[52] U.S. Cl. ..... 430/377; 430/505; 430/550; 430/574

[58] Field of Search ..... 430/553, 505, 574, 550, 430/552, 377

[56] References Cited

U.S. PATENT DOCUMENTS

| | | | |
|---|---|---|---|
| 3,976,492 | 8/1976 | Hinata et al. | 430/574 |
| 4,564,590 | 1/1986 | Sasaki et al. | 430/553 |
| 4,581,324 | 4/1986 | Wolff et al. | 430/553 |
| 4,686,177 | 8/1987 | Aoki et al. | 430/553 |
| 4,770,985 | 9/1988 | Takada et al. | 430/553 |
| 4,882,267 | 11/1989 | Hirabayashi et al. | 430/553 |
| 4,892,810 | 1/1990 | Aoki et al. | 430/553 |
| 4,971,898 | 11/1990 | Aoki et al. | 430/553 |

*Primary Examiner*—Richard L. Schilling
*Attorney, Agent, or Firm*—Finnegan, Henderson, Farabow, Garrett and Dunner

[57] ABSTRACT

A silver halide photographic light-sensitive material comprising a support having thereon a yellow coupler-containing silver halide emulsion layer, a magenta coupler-containing silver halide emulsion layer and a cyan coupler-containing silver halide emulsion layer, wherein at least one of said silver halide emulsion layers contains silver halide grains having a silver chloride content of not less than 80 mol %, at least one of the sensitizing dyes represented by the following Formula [I] and at least one of the sensitizing dyes represented by the following Formula [II]; and said cyan coupler-containing silver halide emulsion layer contains at least one of the cyan couplers represented by the following Formula [III]:

Formula [I]

Formula [II]

Formula [III]

14 Claims, 4 Drawing Sheets

SILVER HALIDE PHOTOGRAPHIC LIGHT-SENSITIVE MATERIAL AND METHOD OF FORMING COLOR IMAGE

FIELD OF THE INVENTION

The present invention relates to a silver halide photographic light-sensitive material which is quickly processable and which permits the obtainment of an image with excellent color reproducibility with high yield, and a method of forming a color image using said light-sensitive material.

BACKGROUND OF THE INVENTION

Silver halide color photographic light-sensitive materials are now used very widely since they have high sensitivity and offer excellent gradation and color reproducibility.

Improvements in equipment such as printers and automatic processing machines have permitted continuous processing and printing processes for a large amount of photographic light-sensitive material and have led to noticeable improvement in labo productivity. On the other hand, equipment size reduction and handling simplification have made it possible to carry out on-site processing in department stores, camera shops, etc. There have been increasing number of such mini-labos with the development of silver halide photographic light-sensitive materials and processing solutions which permit further shortening of processing time.

A shortcoming of the mini-labo is that processing conditions are more liable to changes in comparison with large apparatuses because the amount of processing solutions used is small and the photographic light-sensitive material processed undergoes wide quantitative fluctuation. Another shortcoming is that it remains impossible to automatically obtain a best print in all cases despite printer improvements such as optimization of printing-exposure using a scanner etc. Particularly, in the case of printing from a negative film obtained by picture taking under tungsten lighting or in the twilight, lowering of color reproduction quality always leads to yield reduction in ordinary printers based on the system wherein negative film density is measured to determine and control the amount of exposure for printing.

Use of a silver halide light-sensitive material having a high silver chloride content permits quick development, making it suitable for use in mini-labos; however, the material suffers faulty that print density shows wide fluctuation due to changes in negative film picture-taking conditions as stated above.

Japanese Patent Publication Open to Public Inspection No. 107531/1983 discloses that spectral sensitivity desirable for color reproduction is obtained by use of a silver halide light-sensitive material having a high silver chloride content in combination with a blue sensitizing dye. Japanese Patent Examined Publication No. 34534/1979 discloses that a supersensitizing effect is obtained and desirable spectral sensitivity is obtained by using blue sensitizing dyes of the present invention described later in combination. In any case, however, a problem of printing yield reduction of automatic printer is posed on color paper comprising a silver halide light-sensitive material having a high silver chloride content, and there have been no descriptions on improvement of the above problem by use of a combination of sensitizing dyes of the present invention or significant improvement in green color reproduction at the same time by use of a combination of a blue sensitive photographic emulsion and cyan coupler of the present invention.

There have been various improvements in the exposure control system for color printers with the aim of yield improvement. Examples of such attempts include the method wherein the filter for negative film densitometry is changed according to the color paper used and a scanner is used for color negative film densitometry for the purpose of performing optimal exposure control. However, even such printers remain incapable of providing a constantly high quality color print from every negative film and required separate condition setting according to the situation. Print quality stabilization on the color paper side does not contradict these printer improvements but supplements each other to accomplish the purpose.

SUMMARY OF THE INVENTION

The object of the present invention is to provide a silver halide photographic light-sensitive material permitting quick obtainment of an image with excellent color reproduction quality with high yield and a method of forming a color image using said light-sensitive material.

The present inventors made intensive investigations and found that the object described above can be accomplished by a silver halide photographic light-sensitive material and a method of forming a color image, each comprising as follows:

(1) A silver halide photographic light-sensitive material having a silver halide emulsion layer containing a yellow coupler, a silver halide emulsion layer containing a magenta coupler and a silver halide emulsion layer containing a cyan coupler on a support, wherein at least one of the silver halide emulsion layers described above contains a silver halide emulsion having a silver chloride content of not less than 80 mol %, at least one of the sensitizing dyes represented by the following formula [I] and at least one of the sensitizing dyes represented by the following formula [II] and wherein at least one of the cyan couplers described above is represented by the following formula [III].

Formula [I]

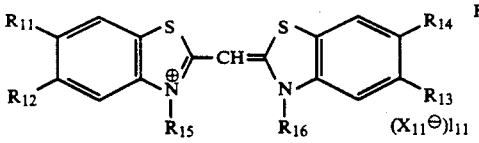

wherein $R_{11}$, $R_{12}$, $R_{13}$ and $R_{14}$ independently represent a hydrogen atom, a halogen atom, an alkyl group, an alkoxy group, an aryl group or a hydroxyl group; $R_{15}$ and $R_{16}$ independently represent an alkyl group. $X_{11}^{\ominus}$ represents an anion; $l_{11}$ represents 0 or 1.

Formula [II]

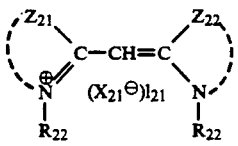

wherein $Z_{21}$ and $Z_{22}$ independently represent a group of atoms necessary for the formation of a benzothiazole nucleus, a benzoselenazole nucleus, a naphthothiazole nucleus or a naphthoselenazole nucleus, at least one of which represents a naphthothiazole nucleus or a naphthoselenazole nucleus. $R_{21}$ and $R_{22}$ independently represent an alkyl group, an alkenyl group or an aryl group. $X_{21}^{\ominus}$ represents an anion; $l_{21}$ represents 0 or 1.

Formula [III]

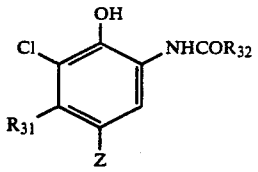

wherein $R_{31}$ represents an alkyl group having a carbon number of 2 to 6; $R_{32}$ represents a ballast group. Z represents a hydrogen atom or an atom or group capable of splitting off upon the reaction with the oxidation product of a color developing agent.

(2) A method of forming a color image containing a process of color paper exposure using a printer based on the system wherein the density of a color negative film is measured to determine and control the amount of exposure of the color paper, wherein said color paper is the silver halide photographic light-sensitive material described in (1) above.

x: Picture was taken using a yellow filter.

o: Picture was taken using a red filter.

Figure 2:
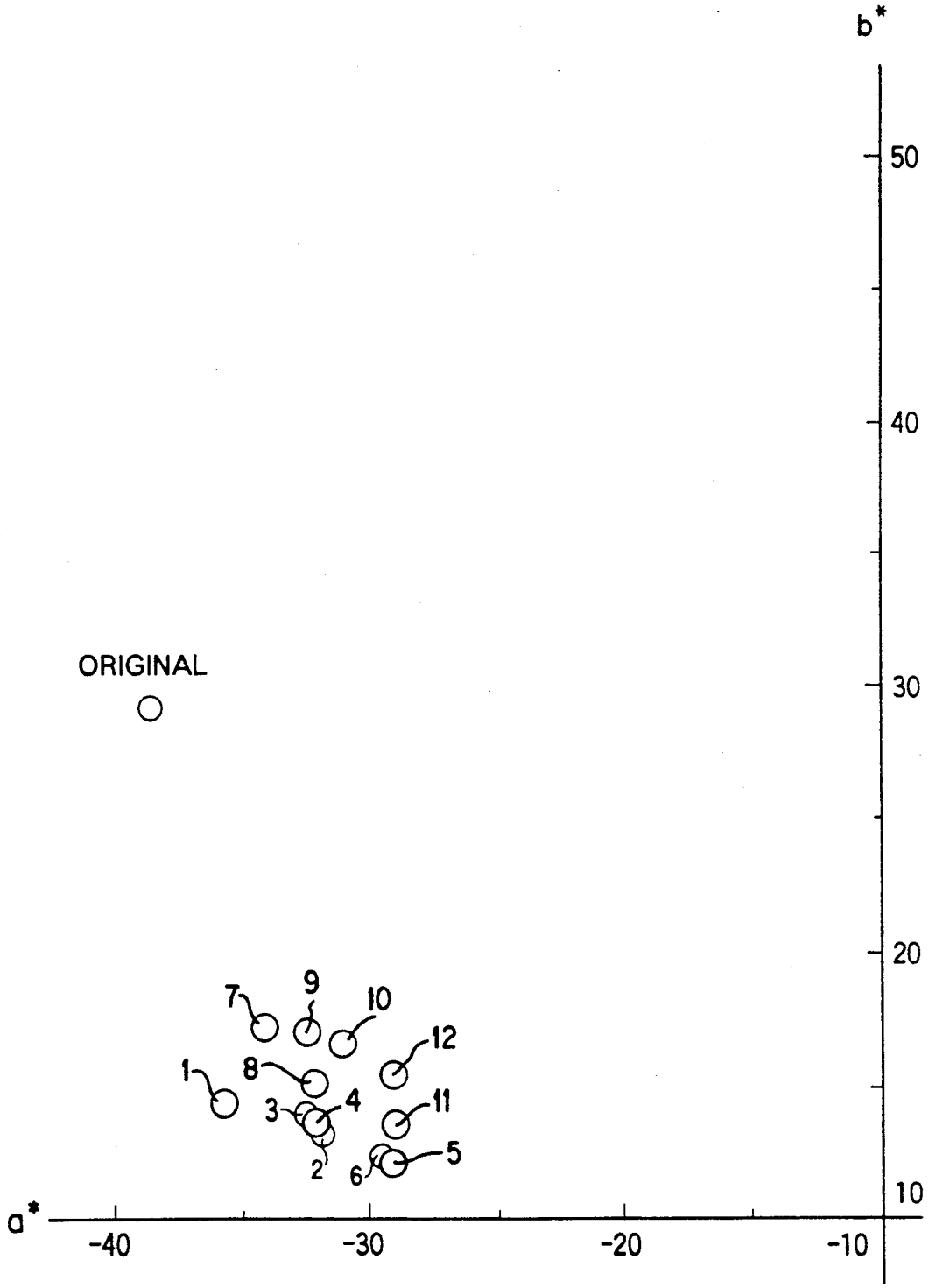

FIG. 2 shows the reproduction of green color on Macbeth color checker by the CIE 1976 (L*a*b*) color space. The abscissa indicates a*, and the ordinate indicates b*. o represents the color reproduced in each sample. The figures are sample numbers with their leading number omitted.

Figure 3:
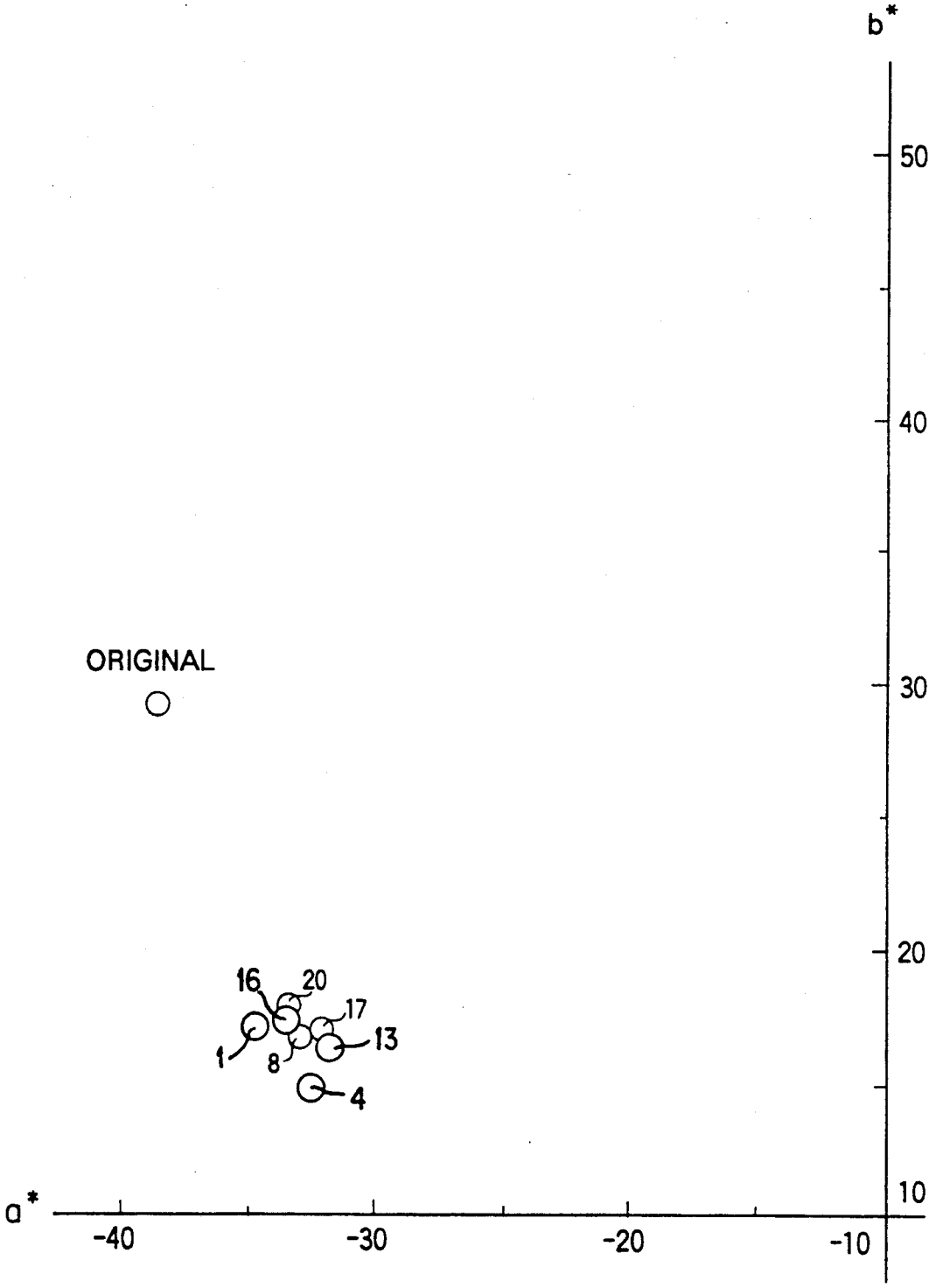
Figure 4:
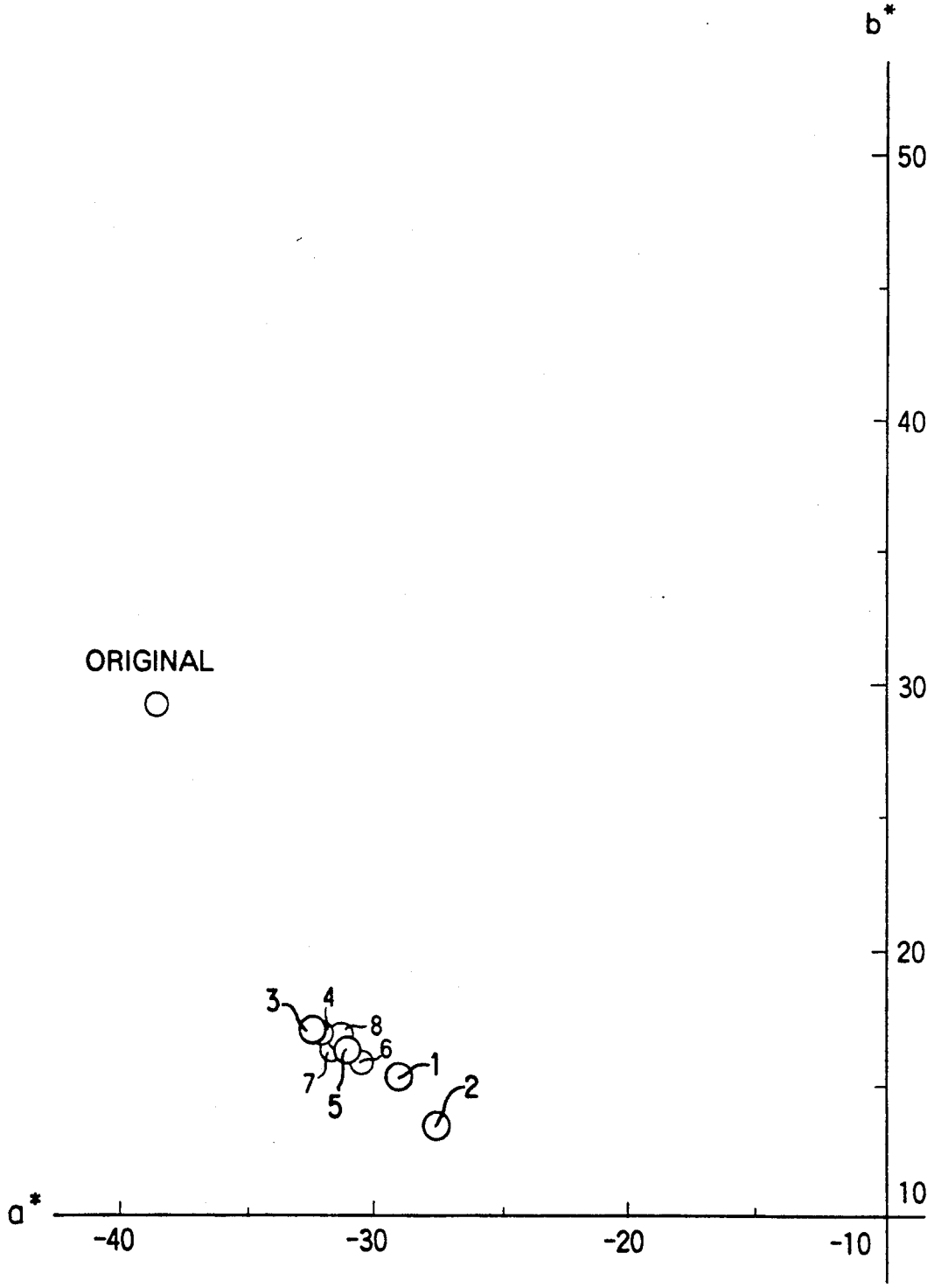

FIGS. 3 and 4 show results of Examples 2 and 3 similar to those shown in FIG. 2.

DETAILED DESCRIPTION OF THE INVENTION

The present invention is hereinafter described in more detail.

The silver halide grains of the present invention have a silver chloride content of not less than 80 mol % and preferably have a silver bromide content of not more than 20 mol % and a silver iodide content of not more than 0.5 mol %. More preference is given to a silver bromochloride having a silver bromide content of 0.1 to 2 mol %.

The composition of the silver halide grains of the present invention may be uniform from inside to outside or may be different between inside and outside. When the inside composition differs from the outside composition, the compositional change may be continuous or uncontinuous. There is no limitation on the grain size of the silver halide grains of the present invention, but in view of rapid processing, sensitivity and other photographic properties, it is preferable that the grain size be in the range of from 0.2 to 1.6 μm, more preferably 0.25 to 1.2 μm. The grain size can be measured by various methods commonly used in relevant fields. Typical methods are described by R. P. Loveland in "Particle-Size Measurement" (ASTM Symposium on Light Microscopy, 1955, pp. 94–122) and by Mees and James in "The Theory of the Photographic Process", 3rd edition, published by McMillan (1966), Chapter 2.

This grain size can be determined from grain projection area or approximated diameter. When the grains are substantially uniform in shape, their grain size distribution can be expressed fairly correctly as a diameter or projection area.

The grain size distribution of the silver halide grains of the present invention may be polydispersed or monodispersed, with preference given to monodispersed silver halide grains wherein the coefficient of variation of grain size distribution is not more than 0.22, more preferably not more than 0.15. Here, the coefficient of variation indicates the width of grain size distribution and is defined by the equations given below.

$$\text{Coefficient of variation } (S/r) = \frac{\text{standard deviation of grain size distribution}}{\text{average grain size}}$$

$$\text{Standard deviation } (S) \text{ of grain size distribution} = \sqrt{\frac{\Sigma(r - ri)^2 ni}{\Sigma ni}}$$

$$\text{Average grain size } (r) = \frac{\Sigma niri}{\Sigma ni}$$

Here, ri represents the grain size of each grain and ni represents the number of grains, wherein the grain size means the diameter of the silver halide grain when it is in a globular form, or the diameter of the circular image converted from its projection image having the same area when it is in a cubic or other nonglobular form.

The silver halide grains used for the emulsion of the present invention may be obtained by any of the acidic method, the neutral method, the ammonia method. These grains may be grown at a time or grown after seed grain preparation. The method of seed grain preparation and the method of grain growth may be identical or not.

The mode of reaction of a soluble silver salt and a soluble halide may be any of the normal precipitation method, the reverse precipitation method, the double-jet precipitation method and combinations thereof, but preference is given to those obtained by the double-jet precipitation method. The PAg-controlled double-jet method described in, for example, Japanese Patent Publication Open to Public Inspection No. 48521/1979 can also be used as a mode of the double-jet precipitation method.

A solvent for silver halide such as thioether may be used as desired. Also, a compound containing a mercapto group, a nitrogen-containing heterocyclic compound or a sensitizing dye compound may be added at the time of formation of silver halide grains or after completion of grain formation. Any shape can be used for the silver halide grains of the present invention. An example of preferable shape is a cube having a (100) face as a crystalline surface. It is also possible to prepare octahedral, tetradecahedral or dodecahedral grains by the methods described in references such as U.S. Pat. Nos. 4,183,756 and 4,225,666, Japanese Patent Publication Open to Public Inspection No. 26589/1980, Japanese Patent Examined Publication No. 42737/1980 and the Journal of Photographic Science, 21, 39 (1973) and use them. Grains having a twin face may be used.

The silver halide grains of the present invention may be in a single shape or may comprise a number of different shapes. The silver halide grains used for the emulsion of the present invention may have metal ions as added using a cadmium salt, a zinc salt, a lead salt, a thallium salt, an iridium salt or complex, a rhodium salt or complex or an iron salt or complex inside and/or on the surface thereof during grain formation and/or growth. Also, it is possible to provide a reduction sensitizing nucleus for the grains inside and/or on the surface thereof by keeping them in an appropriate reductive atmosphere.

After completion of silver halide grain growth, the unnecessary soluble salts may be removed from the emulsion containing silver halide grains of the present invention (hereinafter referred to as the emulsion of the present invention), or may remain contained therein. These salts can be removed in accordance with the method described in Research Disclosure No. 17643.

The silver halide grains used for the emulsion of the present invention may be such grains that a latent image is formed mainly on their surface, or such grains that a latent image is formed mainly therein, with preference given to grains wherein a latent image is formed mainly on their surface.

The emulsion of the present invention is chemically sensitized by a standard method. Accordingly, it is possible to use singly or in combination the sulfur sensitization method, which uses active gelatin or a compound containing sulfur capable of reacting with silver ion, the selenium sensitization method, which uses a selenium compound, the reduction sensitization method, which uses a reducing agent, and the noble metal sensitization method, which uses gold or another noble metal compound.

In the general formula [I] for sensitizing dyes used for the present invention, $R_{11}$, $R_{12}$, $R_{13}$ and $R_{14}$ independently represent a hydrogen atom, a halogen atom, an alkyl group, an alkoxy group, an aryl group or a hydroxyl group. Examples of the halogen atom include a chlorine atom. Examples of the alkyl group include methyl groups having a carbon number of 1 to 6 such as a methyl group and an ethyl group. Examples of the alkoxy group include those having a carbon number of 1 to 6 such as a methoxy group and an ethoxy group. It is preferable that at least one of them is a chlorine atom, and it is more preferable that two of $R_{11}$, $R_{12}$, $R_{13}$ and $R_{14}$ are chlorine atoms.

$R_{15}$ and $R_{16}$ independently represent an alkyl group, including those having a substituent. It is preferable that $R_{15}$ and $R_{16}$ be unsubstituted alkyl groups or alkyl groups substituted with a carboxyl group or a sulfo group. It is more preferable that $R_{15}$ and $R_{16}$ be alkyl groups substituted with a carboxyl group or a sulfo group. It is ideal that $R_{15}$ and $R_{16}$ be sulfoalkyl groups or carboxyalkyl groups having a carbon number of 1 to 4.

$R_{15}$ and $R_{16}$ may be identical or not, but it is preferable that either one is an alkyl group having a carbon number of 1 to 4 substituted with a carboxyl group.

$X_{11}^{\ominus}$ represents an anion. Examples of it include halide ions (e.g. $Br^{\ominus}$ and $I^{\ominus}$), which are not limitative.

When $l_{21}$ is 0, the absence of anion is acceptable and $R_{15}$ or $R_{16}$ forms an intramolecular salt.

Sensitizing dyes represented by Formula [I] are each known compounds, and can easily be synthesized in accordance with, for example, British Patent No. 660,408, U.S. Pat. No. 3,149,105, Japanese Patent Publication Open to Public Inspection No. 4127/1975 or "The Cyanine Dyes and Related Compounds", written by F. M. Hamer, Interscience Publishers, N.Y., 1969, pp. 32–76.

Examples of sensitizing dyes represented by Formula [I] used for the present invention are given in the table below, but these are not to be construed as limitative on the choice of compounds for the present invention.

Formula [I]

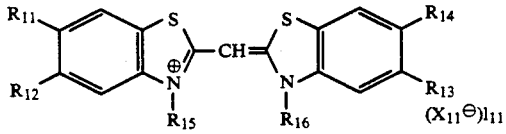

| Compound No. | $R_{11}$ | $R_{12}$ | $R_{15}$ | $R_{16}$ | $R_{13}$ | $R_{14}$ | $X_{11}^{\ominus}$ |
|---|---|---|---|---|---|---|---|
| I-1 | H | H | $-(CH_2)_3SO_3^{\ominus}$ | $-(CH_2)_3SO_3H$ | H | H | — |
| I-2 | H | —Cl | $-(CH_2)_3SO_3^{\ominus}$ | $-(CH_2)_3SO_3H$ | —Cl | H | — |
| I-3 | H | —Cl | $-(CH_2)_3SO_3^{\ominus}$ | $-CH_2COOH$ | —Cl | H | — |
| I-4 | H | $-CH_3$ | $-(CH_2)_2CH(CH_3)SO_3^{\ominus}$ | $-(CH_2)_3SO_3Na$ | $-CH_3$ | H | — |
| I-5 | H | 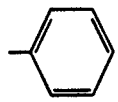 | $-(CH_2)_2SO_3^{\ominus}$ | $-C_2H_5$ | —Cl | H | — |
| I-6 | H | $-OCH_3$ | $-(CH_2)_3SO_3^{\ominus}$ | $-(CH_2)_3SO_3H.N(C_2H_5)_3$ | $-OCH_3$ | H | — |
| I-7 | —Cl | —Cl | $-(CH_2)_4SO_3^{\ominus}$ | $-(CH_2)_4SO_3H.N(C_2H_5)_3$ | —Cl | H | — |
| I-8 | H | —CN | $-(CH_2)_3SO_3^{\ominus}$ | $-(CH_2)_2COOH$ | —CN | H | — |
| I-9 | H | —Cl | $-C_2H_5$ | $-C_2H_5$ | —Cl | H | $I^{\ominus}$ |
| I-10 | H | —Cl | $-(CH_2)_3SO_3^{\ominus}$ | $-(CH_2)_2OH$ | —Cl | H | — |

-continued

Formula [I]

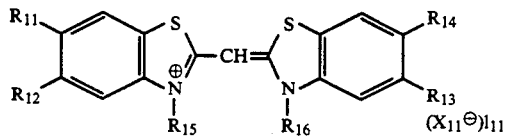

| Compound No. | $R_{11}$ | $R_{12}$ | $R_{15}$ | $R_{16}$ | $R_{13}$ | $R_{14}$ | $X_{11}^{\ominus}$ |
|---|---|---|---|---|---|---|---|
| I-11 | —Cl | —Cl | $-(CH_2)_3SO_3^{\ominus}$ | $-(CH_2)_2CH(CH_3)SO_3H.N(C_2H_5)_3$ | 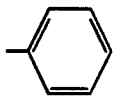 | H | — |
| I-12 | —Cl | —Cl | $-(CH_2)_2SO_3^{\ominus}$ | $-(CH_2)_2COOH$ | —Cl | H | — |
| I-13 | H | $-OCH_3$ | $-C_2H_5$ | $-(CH_2)_2OH$ | $-OCH_3$ | H | $Br^{\ominus}$ |
| I-14 | H | $-OCH_3$ | $-(CH_2)_3SO_3^{\ominus}$ | $-(CH_2)_2COOC_2H_5$ | $-CH_3$ | H | — |

Sensitizing dyes represented by Formula [II] are described below.

The benzothiazole, benzoselenazole, naphthothiazole or naphthoselenazole nucleus formed by $Z_{21}$ and $Z_{22}$ may have a substituent. Examples of preferable substituents include halogen atoms, a hydroxyl group, aryl groups, alkyl groups and alkoxy groups.

Of the halogen atoms, a chlorine atom is particularly preferable. The aryl group is preferably a phenyl group. The alkyl group is preferably a normal or branched alkyl group having a carbon number of 1 to 4, including a methyl group, an ethyl group, a propyl group, an isopropyl group and a butyl group, with more preference given to a methyl group. The alkoxy group preferably has a carbon number of 1 to 4. Examples of such alkoxy groups include a methoxy group, an ethoxy group and a propoxy group, with more preference given to a methoxy group.

The alkyl group represented by $R_{21}$ or $R_{22}$ is preferably a normal or branched alkyl group having a carbon number of 1 to 6, including a methyl group, an ethyl group, a propyl group and an isopropyl group. These alkyl groups may be substituted. Examples of preferable substituents include a sulfo group, a carboxyl group, a hydroxyl group, alkoxycarbonyl groups and alkylsulfonylamino groups. The alkyl group represented by $R_{21}$ or $R_{22}$ is preferably an alkyl group substituted by a sulfo group or a carboxyl group, wherein the sulfo group and carboxyl group may form a salt with an organic cation such as a pyridinium ion or triethylammonium ion or an inorganic cation such as ammonium ion, sodium ion or potassium ion.

The anion represented by $X_{21}^{\ominus}$ is preferably a chloride ion, a bromide ion, an iodide ion or a p-toluenesulfonic acid ion, with more preference given to a silver halide ion. When an intramolecular salt is formed, the absence of an anion is acceptable, wherein $l_{21}$ represents 0.

Typical examples of sensitizing dyes represented by Formula [II] shown above are given below.

II-1

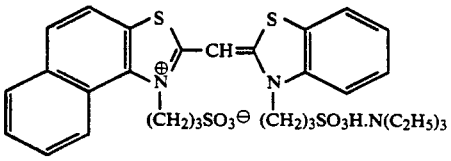

-continued

II-2

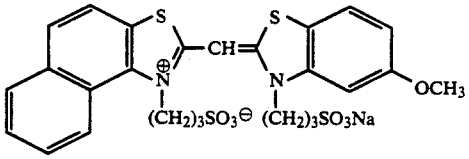

II-3

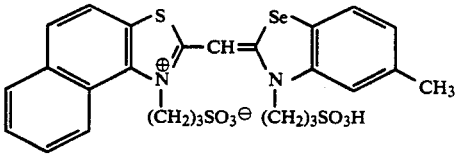

II-4

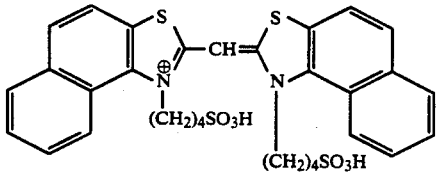

II-5

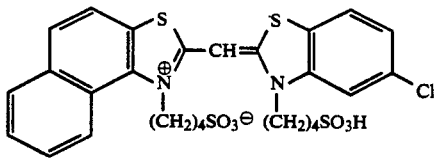

II-6

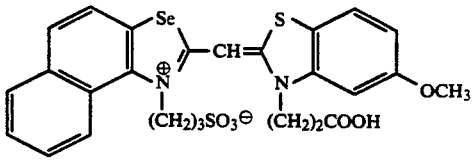

II-7

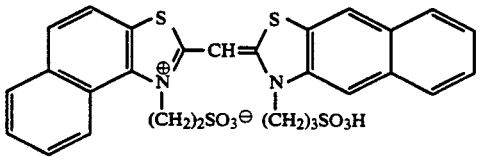

-continued

II-8

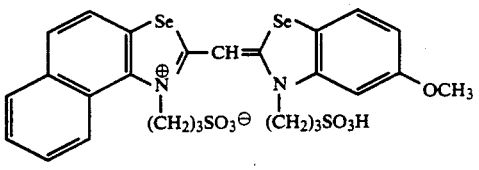

II-9

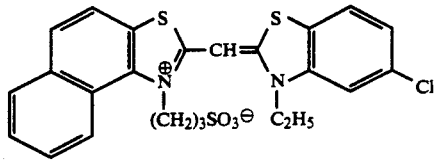

II-10

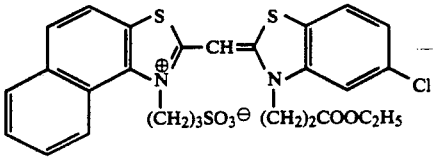

II-11

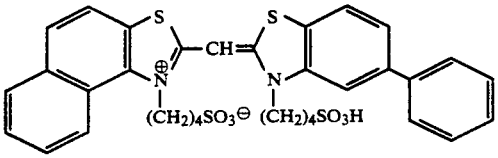

II-12

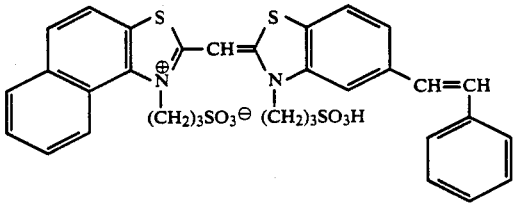

These compounds are generally known and can easily be synthesized by the method described in the above-mentioned reference "The Cyanine Dyes and Related Compounds".

It is preferable to use the blue sensitizing dyes [I] and [II] of the present invention in a molar ratio of 1:1 to 20:1, more preferably 1:1 to 10:1.

It is preferable to use these dyes [I] and [II] in a total amount of $5\times10^{-5}$ to $2\times10^{-3}$ mol, more preferably $1\times10^{-4}$ to $7\times10^{-4}$ mol, per mol silver halide.

Concerning the timing of addition of these sensitizing dyes, they may be added at any time between silver halide grain formation and coating, but it is preferable to add them between completion of silver halide grain formation and coating.

These sensitizing dyes may be added to a silver halide emulsion in the form of a dispersion prepared by dispersing them in a water-miscible organic solvent without dissolution, or in the form of a solution prepared by dissolving them in water or a water-miscible organic solvent such as methanol, ethanol, acetone or dimethylformamide or a mixture thereof.

Concerning the cyan coupler represented by Formula [III], the alkyl group represented by $R_{31}$ may be normal or branched, and includes those having a substituent.

The ballast group represented by $R_{32}$ is an organic group having a size and shape that provide the coupler molecule with sufficient bulkiness to substantially prevent the coupler from diffusing from the layer to which the coupler is added to another layer. The ballast group is preferably represented by the following formula:

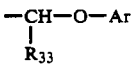

wherein $R_{33}$ represents an alkyl group having a carbon number of 1 to 12; Ar represents an aryl group such as a phenyl group, which includes those having a substituent.

Examples of couplers represented by Formula [III] are given below, but these are not to be construed as limitative.

Formula [II]

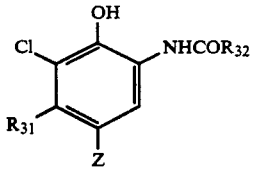

| Coupler No. | $R_{31}$ | Z | $R_{32}$ |
|---|---|---|---|
| III-1 | $-C_2H_5$ | $-Cl$ | 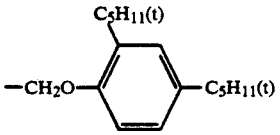 |
| III-2 | $-C_2H_5$ | 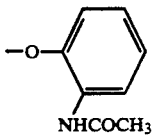 | 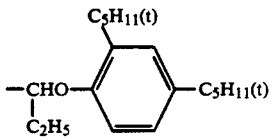 |

-continued
Formula [II]
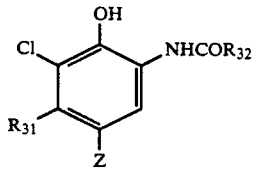
| Coupler No. | $R_{31}$ | Z | $R_{32}$ |
|---|---|---|---|
| III-3 | $-C_3H_7(i)$ | $-Cl$ | 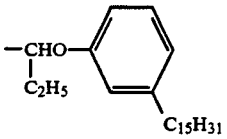 |
| III-4 | $-C_2H_5$ | $-Cl$ | 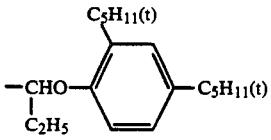 |
| III-5 | $-C_4H_9$ | $-F$ | 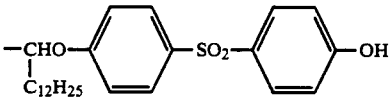 |
| III-6 | $-C_2H_5$ | $-F$ | 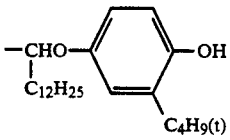 |
| III-7 | $-C_2H_5$ | $-Cl$ | 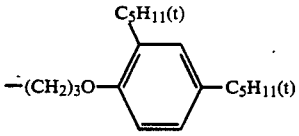 |
| III-8 | $-C_2H_5$ | $-Cl$ | 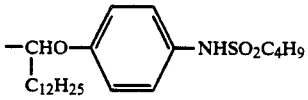 |
| III-9 | $-C_2H_5$ | $-Cl$ | 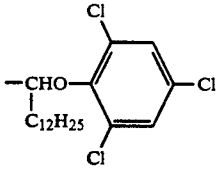 |
| III-10 | $-C_3H_7(i)$ | $-Cl$ | $-C_{18}H_{37}$ |
| III-11 | $-C_6H_{13}$ | $-Cl$ | 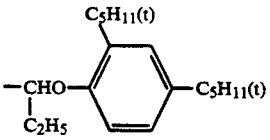 |
| III-12 | $-C_3H_7$ | $-Cl$ | 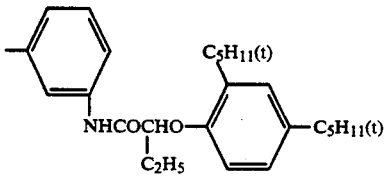 |

-continued

Formula [II]

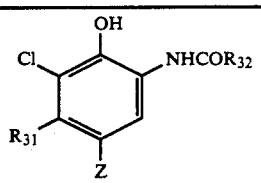

| Coupler No. | $R_{31}$ | Z | $R_{32}$ |
|---|---|---|---|
| III-13 | $-(CH_2)_2NHCOCH_3$ | $-Cl$ | 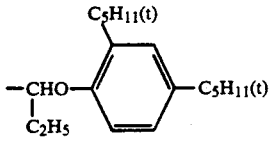 |
| III-14 | $-(CH_2)_2OCH_3$ | $-Cl$ | 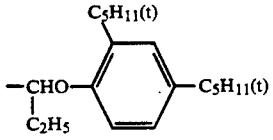 |
| III-15 | $-C_2H_5$ | $-Cl$ | 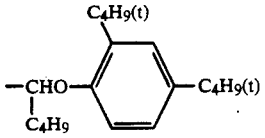 |
| III-16 | $-C_4H_9(t)$ | $-O(CH_2)_2-SO_2CH_3$ | 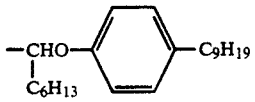 |
| III-17 | $-C_2H_5$ | $-Cl$ | 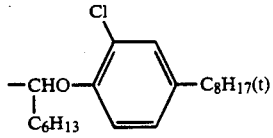 |
| III-18 | $-C_2H_5$ | $-Cl$ | 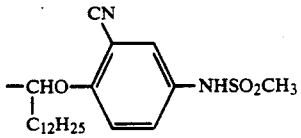 |
| III-19 | $-C_2H_5$ | $-Cl$ | 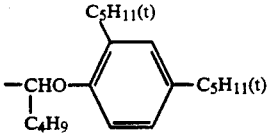 |

Including these examples, cyan couplers usable for the present invention are exemplified in, for example, Japanese Patent Examined Publication No. 11572/1974 and Japanese Patent Publication Open to Public Inspection Nos. 3142/1986, 9652/1986, 9653/1986, 39045/1986, 50136/1986, 99141/1986 and 105545/1986.

The cyan dye forming coupler of the present invention represented by Formula [III] shown above can be used in the range of $1\times10^{-3}$ mol to 1 mol, preferably $1\times10^{-2}$ mol to $8\times10^{-1}$ mol, per mol silver halide.

For the present invention, it is preferable to use a pivaloylacetoanilide-based yellow coupler.

The yellow coupler can be added to any silver halide emulsion layer, but it is preferable to add it to a blue-sensitive silver halide emulsion layer. It is preferable to add it in an amount of $2\times10^{-3}$ to $5\times10^{-1}$ mol, more preferably $1\times10^{-2}$ mol to $5\times10^{-1}$ mol, per mol silver halide, Typical examples of yellow couplers used preferably are given below, but these are not to be construed as limitative.

YC-1

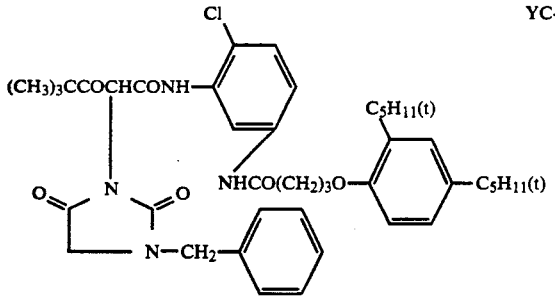

YC-2

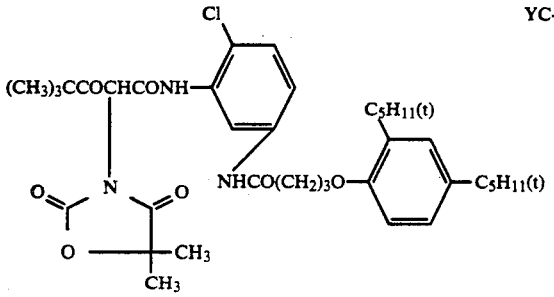

YC-3

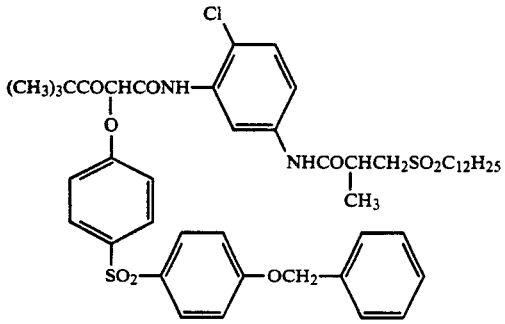

-continued

YC-4

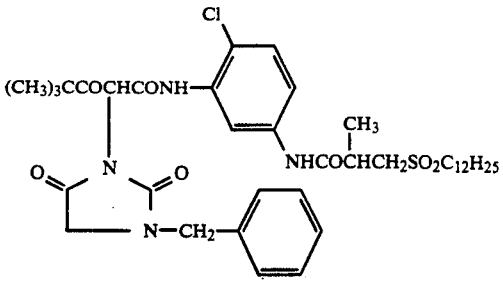

YC-5

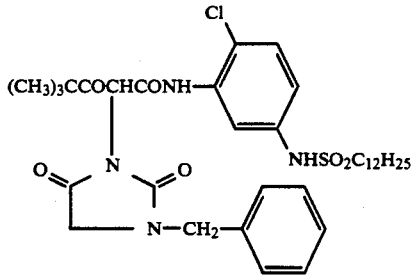

YC-6

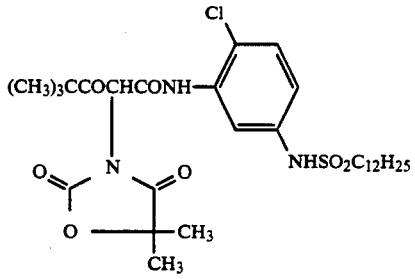

The magenta coupler for the present invention is preferably a pyrazoloazole or a 3-anilinopyrazolone.

Although the amount of magenta coupler added varies according to the type of compound, it is normally used in an amount of $1\times10^{-3}$ to 2 mols, preferably $1\times10^{-2}$ mol to 1 mol, per mol silver halide.

Typical examples of magenta couplers used preferably are given below, but these are not to be construed as limitative.

MC-1

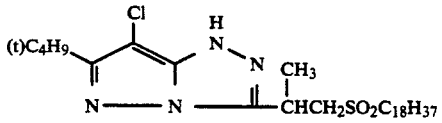

MC-2

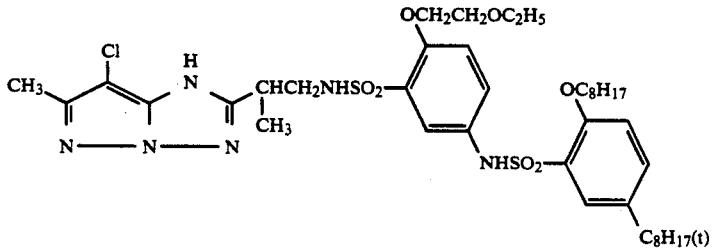

-continued
MC-3
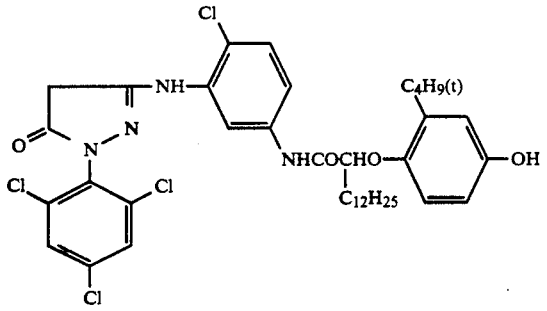
MC-4
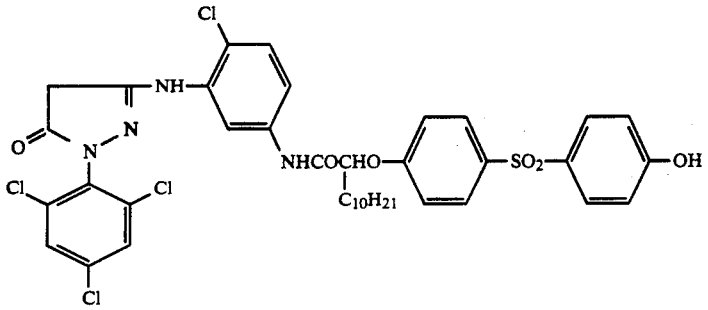
MC-5
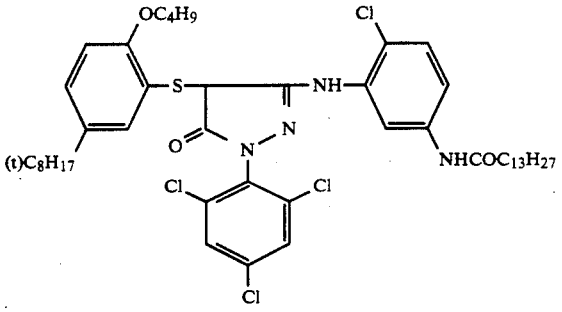
MC-6
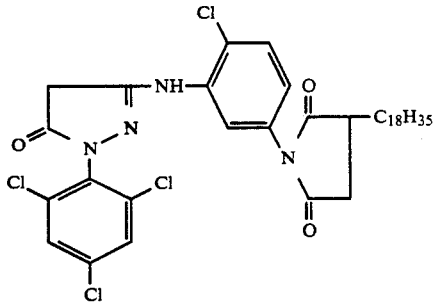
For the present invention, the cyan coupler represented by Formula [III] can be used in combination with another cyan coupler as long as it does not hamper the effect of the present invention.
Typical examples of cyan couplers which can be used in combination are given below, but these are not to be construed as limitative.
CC-1
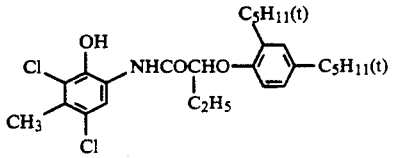
-continued
CC-2
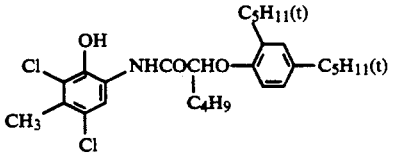
CC-3
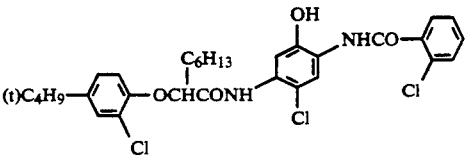

-continued

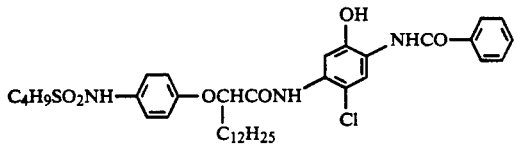

CC-4

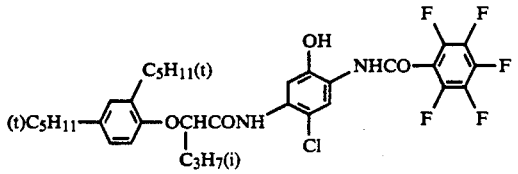

CC-5

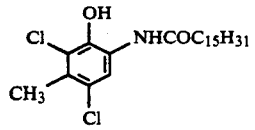

CC-6

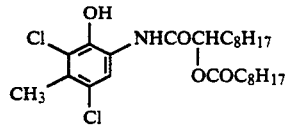

CC-7

It is preferable that the ratio of the cyan coupler represented by Formula [III] to the cyan coupler used in combination therewith be 10:0 to 5:5 (molar ratio), more preferably 10:0 to 6:4.

For adding hydrophobic compounds such as these couplers to a silver halide emulsion, the oil-in-water emulsion dispersion method is applicable, in which the additive is dissolved in a high-boiling organic solvent and this solution is dispersed. It is recommended that the additive be dissolved in the high-boiling organic solvent described above having a boiling point of not lower than about 150° C., in the presence of a low-boiling and/or water-soluble organic solvent used as desired, and this solution is emulsified and dispersed in a hydrophilic binder such as an aqueous solution of gelatin in the presence of a surfactant using a means of dispersion such as an agitator, a homogenizer, a colloid mill, a flow mixer or an ultrasonic homogenizer.

After or upon dispersion, a process of low-boiling organic solvent removal may be added.

Examples of high-boiling organic solvents used preferably for this purpose include phthalates such as dibutyl phthalate, di-(2-ethylhexyl) phthalate, dinonyl phthalate and dicyclohexyl phthalate; phosphates such as tricresyl phosphate, tri-(2-ethylhexyl) phosphate, di-phenyl-cresyl phosphate and trihexyl phosphate; organic acid amides such as diethyl lauramide and dibutyl lauramide; phenols such as dinonyl phenol and p-dodecyl phenol; hydrocarbons such as decalin and dodecylbenzene; and esters such as 1,4-bis(2-ethylhexylcarbonyloxymethyl)cyclohexane and dinonyl adipate. It is more preferable to use an ester of organic acid such as phthalic acid or phosphoric acid. These high-boiling organic solvents may be used singly or in combination.

The silver halide photographic light-sensitive material of the present invention can be a color negative or positive film and color printing paper, but the effect of the method of the present invention is enhanced when it is applied to color photographic paper for direct viewing.

The silver halide photographic light-sensitive material of the present invention, including this color photographic paper, has a structure wherein one or more silver halide emulsion layer each containing a magenta coupler, a yellow coupler and a cyan coupler and one or more non-light-sensitive layers are layered in appropriate number and order on a support for the purpose of subtractive color reproduction. The number and order of layers may be altered as appropriate according to the key performance and the purpose of use.

The particularly preferable layer structure for the silver halide photographic light-sensitive material of the present invention is such that a yellow dye image forming layer, an interlayer, a magenta dye image forming layer, an interlayer, a cyan dye image forming layer, an interlayer and a protective layer are arranged on the support in this order from the support.

The silver halide emulsion of the present invention can be optically sensitized to the desired wavelength range using a dye known as a sensitizing dye in the photographic industry.

Also, the silver halide emulsion of the present invention may contain a known antifogging agent and/or a stabilizer for the purpose of fogging prevention and/or photographic performance stabilization.

It is advantageous to use gelatin as a binder (or protective colloid) for the silver halide emulsion of the present invention, but it is possible to use other substances such as gelatin derivatives, graft polymers of gelatin and another polymer, proteins, sugar derivatives, cellulose derivatives and hydrophilic colloids of synthetic hydrophilic polymers such as homo- or copolymers.

In addition to these additives, the silver halide photographic light-sensitive material of the present invention can contain as appropriate a hardener, a plasticizer, a polymer latex, an anti-stain agent, an ultraviolet absorbent, a dye image stabilizer, a mordant, a development accelerator, a development retarder, a fluorescent brightening agent, a matting agent, a lubricant, an antistatic agent and a surfactant.

The silver halide photographic light-sensitive material of the present invention is prepared by forming a silver halide emulsion layer and another hydrophilic colloidal layer on a support normally used in the photographic industry by a standard method.

The silver halide photographic light-sensitive material of the present invention is capable of forming an image by carrying out a known color developing process obvious to those skilled in the art.

The color developing agent used in the color developer to develop the silver halide photographic light-sensitive material of the present invention includes aminophenol and p-phenylenediamine derivatives used widely for various color photographic processes.

The color developer employed to develop the silver halide photographic light-sensitive material of the present invention may be formulated with a known developer component compound in addition to the primary amine-based color developing agent described above.

It is preferable that the silver halide photographic light-sensitive material of the present invention be processed with a color developer free of benzyl alcohol.

The silver halide photographic light-sensitive material of the present invention is subjected to bleaching and fixation after color development. Bleaching may be carried out simulataneously with fixation.

After fixation, water washing is normally carried out. Also, stabilization may be carried out without water washing.

EXAMPLES

The present invention is hereinafter described in more detail by means of the following examples, but the mode of embodiment of the invention is not by any means limited by them.

EXAMPLE 1

A paper support laminated with polyethylene on one face and titanium dioxide-containing polyethylene on the first layer side on the other face was coated with layers having the compositions shown in Table 1 to yield a multiple layer silver halide color photographic light-sensitive material. Coating solutions were prepared as follows:

First layer coating solution 26.7 g of yellow coupler YC-4, 10.0 g of dye image stabilizer ST-1, 6.7 g of dye image stabilizer ST-2, 0.67 g of antistaining agent HQ-1 and 6.7 g of high-boiling organic solvent DNP were dissolved in 60 ml of ethyl acetate. This solution was emulsified and dispersed in 200 ml of a 10% aqueous solution of gelatin containing 10 ml of 10% sodium alkylnaphthalenesulfonate using an ultrasonic homogenizer to yield a yellow coupler dispersion. This dispersion was mixed with a blue-sensitive silver halide emulsion prepared under the conditions described below (containing 10 g of silver) to yield a first layer coating solution.

Second through seventh coating solutions were prepared in the same manner as with the first layer coating solution described above except that the second, fourth and seventh layers were formulated with the following hardeners H-1 and H-2 and the following coating aids S-1 and S-2.

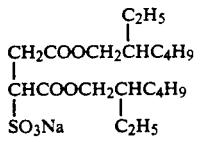

S-1

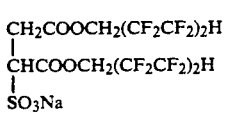

S-2

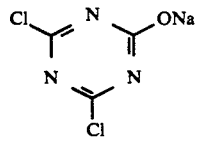

H-1

$C(CH_2SO_2CH{=}CH_2)_4$ H-2

Preparation of blue-sensitive silver halide emulsion

The following solutions A and B were simultaneously added to 1000 ml of a 2% aqueous solution of gelatin warmed at 40° C. over a period of 30 minutes while controlling the pAg at 6.5 and the pH at 3.0, followed by simultaneous addition of the following solutions C and D over a period of 180 minutes while controlling the pAg at 7.3 and the pH at 5.5.

pAg control was achieved by the method described in Japanese Patent Publication Open to Public Inspection No. 45437/1984, and pH control was achieved using an aqueous solution of sulfuric acid or sodium hydroxide.

Solution A
Sodium chloride: 3.42 g
Potassium bromide: 0.03 g
Water was added to reach a total quantity of 200 ml.
Solution B
Silver nitrate: 10 g
Water was added to reach a total quantity of 200 ml.
Solution C
Sodium chloride: 102.7 g
Potassium bromide: 1.0 g
Water was added to reach a total quantity of 600 ml.
Solution D
Silver nitrate: 300 g
Water was added to reach a total quantity of 600 ml.

After completion of the addition, the resulting mixture was desalted with a 5% aqueous solution of Demol N, produced by Kao Atlas, and a 20% aqueous solution of magnesium sulfate, and then mixed with an aqueous solution of gelatin to yield a monodispersed cubic emulsion Em-1 having an average grain size of 0.85 μm, a coefficient of variation ($S/\bar{r}$) of 0.07 and a silver chloride content of 99.5 mol %.

The emulsion Em-1 was chemically ripened using the following compounds at 50° C. for 100 minutes to yield a blue-sensitive silver halide emulsion Em-1B.

Sodium thiosulfate: 0.8 mg/mol AgX
Chloroauric acid: 0.5 mg/mol AgX
Stabilizer SB-1: $6\times10^{-4}$ mol/mol AgX
Sensitizing dye I-3: $4\times10^{-4}$ mol/mol AgX
Sensitizing dye II-2: $1\times10^{-4}$ mol/mol AgX

Preparation of green-sensitive silver halide emulsion

A monodispersed cubic emulsion Em-2 having an average grain size of 0.43 μm, a coefficient of variation ($S/\bar{r}$) of 0.08 and a silver chloride content of 99.5 mol % was obtained in the same manner as with Em-1 except that the duration of addition of solutions A and B and the duration of addition of solutions C and D were altered.

Em-2 was subjected to chemical ripening with the following compounds at 55° C. for 110 minutes to yield a green-sensitive silver halide emulsion Em-2G.

Sodium thiosulfate: 1.2 mg/mol AgX
Chloroauric acid: 1.5 mg/mol AgX
Stabilizer SB-1: $6\times10^{-4}$ mol/mol AgX
Sensitizing dye GS-1: $4.0\times10^{-4}$ mol/mol AgX

Preparation of red-sensitive silver halide emulsion

A monodispersed cubic emulsion Em-3 having an average grain size of 0.50 μm, a coefficient of variation ($S/\bar{r}$) of 0.08 and a silver chloride content of 99.5 mol % was obtained in the same manner as with Em-1 except that the duration of addition of solutions A and B and the duration of addition of solutions C and D were altered.

Em-3 was subjected to chemical ripening with the following compounds at 60° C. for 90 minutes to yield a red-sensitive silver halide emulsion Em-3R.

Sodium thiosulfate: 1.8 mg/mol AgX
Chloroauric acid: 2.0 mg/mol AgX
Stabilizer SB-1: $6\times10^{-4}$ mol/mol AgX
Sensitizing dye RS-1: $8.0\times10^{-5}$ mol/mol AgX Preparation of silver halide emulsion having a high silver bromide content Em-4 (monodispersed cubic emulsion having an average grain size of 0.84 μm, a coefficient of variation (S/$\bar{r}$) of 0.09 and a silver chloride content of 75 mol %) was obtained in the same manner as with Em-1 except that solution C was replaced by the following solution C', the duration of addition of solutions A and B and the duration of addition of solutions C' and D were altered, and the pAg upon addition of solutions C' and D was changed to 7.8.

Em-4 was subjected to chemical ripening in the same manner as with Em 1 except that the duration of ripening alone was changed to yield a blue-sensitive silver halide emulsion Em-4B.

Solution C'
Sodium chloride: 76.2 g
Potassium bromide: 54.1 g
Water was added to reach a total quantity of 600 ml.

Preparation of blue-sensitive emulsions containing a single sensitizing dye

Blue-sensitive emulsions Em-1B', Em-1B'', Em-4B' and Em-4B'' were prepared in the same manner as with Em-1B except that combination of dye (I-3) and (II-2) was replaced by $5\times10^{-4}$ mol/mol AgX of a sensitizing dye I-3 or II-2.

| Emulsion | | Blue sensitizing dye | |
|---|---|---|---|
| Em-1B' | Em-1 | (I-3) | $5\times10^{-4}$ mol/mol AgX |
| Em-1B'' | Em-1 | (II-2) | $5\times10^{-4}$ mol/mol AgX |
| Em-4B' | Em-4 | (I-3) | $5\times10^{-4}$ mol/mol AgX |
| Em-1B'' | Em-4 | (II-2) | $5\times10^{-4}$ mol/mol AgX |

TABLE 1

| Layer | Composition | Coating amount (g/m$^2$) |
|---|---|---|
| 7th layer (protectile layer) | Gelatin | 1.0 |
| 6th layer | Gelatin | 0.6 |

TABLE 1-continued

| Layer | Composition | Coating amount (g/m$^2$) |
|---|---|---|
| (ultraviolet absorbing layer) | Ultraviolet absorbent UV-1 | 0.2 |
| | Ultraviolet absorbent UV-2 | 0.2 |
| | Anti-color mixing agent HQ-1 | 0.01 |
| | Catechol derivative AO-1 | 0.03 |
| | DNP | 0.2 |
| | PVP | 0.03 |
| | Anti-irradiation dye AI-2 | 0.02 |
| 5th layer (red-sensitive layer) | Gelatin | 1.40 |
| | Red-sensitive silver halide emulsion (Em-3R) | *0.24 |
| | Cyan coupler (listed in Table 2) | **$8.5\times10^{-4}$ |
| | Dye image stabilizer ST-1 | 0.20 |
| | High-boiling organic solvent HB-1 | 0.10 |
| | Anti-color mixing agent HQ-1 | 0.01 |
| | DOP | 0.30 |
| 4th layer (ultraviolet absorbing layer) | Gelatin | 1.30 |
| | Ultraviolet absorbent UV-1 | 0.40 |
| | Ultraviolet absorbent UV-2 | 0.40 |
| | Catechol derivative AO-1 | 0.07 |
| | Anti-color mixing agent HQ-1 | 0.03 |
| | DNP | 0.40 |
| 3rd layer (green-sensitive layer) | Gelatin | 1.40 |
| | Green-sensitive silver halide emulsion (Em-2G) | *0.27 |
| | Magenta coupler MC-6 | 0.35 |
| | Potassium bromide | 0.002 |
| | Stabilizer SB-1 | $2\times10^{-4}$ |
| | Dye image stabilizer ST-3 | 0.20 |
| | Dye image stabilizer ST-4 | 0.10 |
| | Anti-color mixing agent HQ-1 | 0.01 |
| | DOP | 0.30 |
| | Anti-irradiation dye AI-1 | 0.01 |
| 2nd layer (interlayer) | Gelatin | 1.20 |
| | Anti-color mixing agent HQ-1 | 0.12 |
| | DIDP | 0.15 |
| 1st layer (blue-sensitive layer) | Gelatin | 1.30 |
| | Blue-sensitive silver halide emulsion (listed in Table 2) | *0.30 |
| | Yellow coupler YC-4 | 0.08 |
| | Dye image stabilizer ST-1 | 0.30 |
| | Dye image stabilizer ST-2 | 0.20 |
| | Anti-color mixing agent HQ-1 | 0.02 |
| | DNP | 0.20 |
| Support | Polyethylene-laminated paper | |

*amount converted to silver
**mol/m$^2$

GS-1

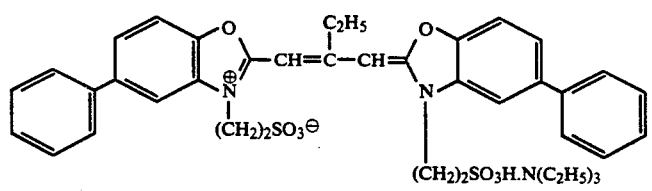

RS-1

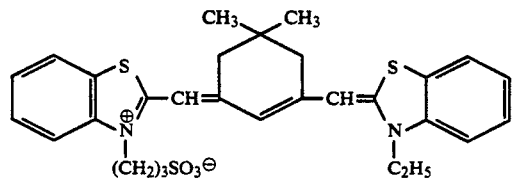

-continued
SB-1
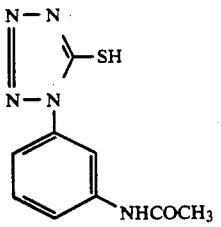
ST-1
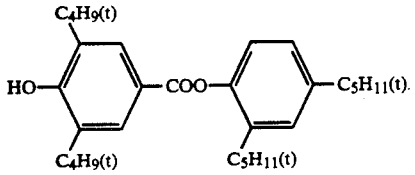
ST-2
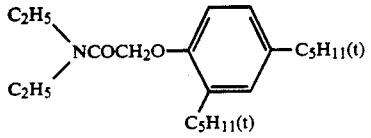
UV-1
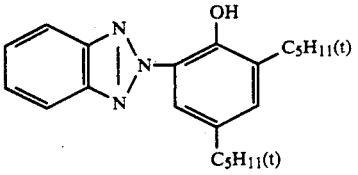
UV-2
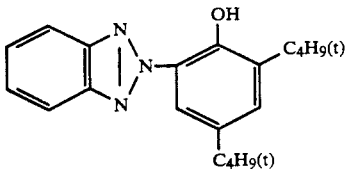
DOP: dioctyl phthalate
DNP: dinonyl phthalate
DIDP: diisodecyl phthalate
PVP: polyvinyl pyrrolidone
HQ-1
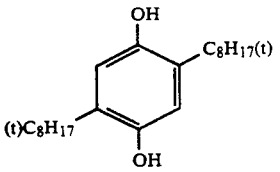
ST-3
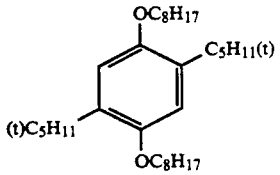
ST-4
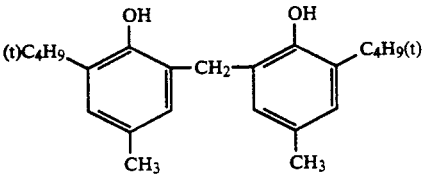

-continued

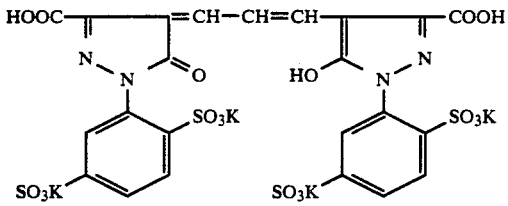

AI-1

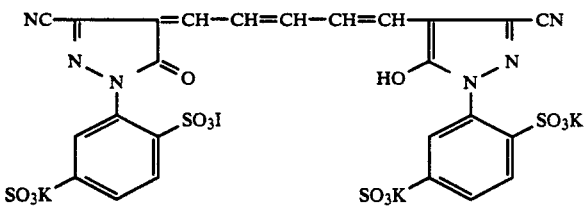

AI-2

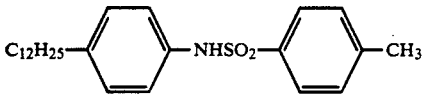

HB-1

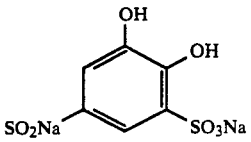

AO-1

The samples shown in Table 2 were prepared using various combinations of silver halide emulsions and couplers.

These samples were exposed in accordance with a standard method and then processed in the following procedures.

| [Process] | Temperature | Time |
|---|---|---|
| Color development | 35.0 ± 0.3° C. | 45 seconds |
| Bleach-fixation | 35.0 ± 0.5° C. | 45 seconds |
| Stabilization | 30 to 34° C. | 90 seconds |
| Drying | 60 to 80° C. | 60 seconds |

Color developer

Water: 800 ml
Triethanolamine: 10 g
N,N-diethylhydroxylamine: 5 g
Potassium bromide: 0.02 g
Potassium chloride: 2 g
Potassium sulfite: 0.3 g
1-hydroxyethylidene-1,1-diphosphonic acid: 1.0 g
Ethylenediaminetetraacetic acid: 1.0 g
Disodium catechol-3,5-disulphonate: 1.0 g
N-ethyl-N-β-methanesulfonamidoethyl-3-methyl-4-aminoaniline sulfate: 4.5 g
Fluorescent brightening agent (4,4'-diaminostilbenedisulfonic acid derivative): 1.0 g
Potassium carbonate: 27 g
Water was added to reach a total quantity of 1 l, and pH was adjusted to 10.10.

Bleach-Fixer

Ferric ammonium ethylenediaminetetraacetate dihydrate: 60 g
Ethylenediaminetetraacetic acid: 3 g
Ammonium thiosulfate (70% aqueous solution): 100 ml
Ammonium sulfite (40% aqueous solution): 27.5 ml
Water was added to reach a total quantity of 1 l, and pH was adjusted to 5.7 with potassium carbonate or glacial acetic acid.

Stabilizer 5-chloro-2-methyl-4-isothiazolin-3-one: 1.0 g
Ethylene glycol: 1.0 g
1-hydroxyethylidene-1,1-diphosphonic acid: 2.0 g
Ethylenediaminetetraacetic acid: 1.0 g
Ammonium hydroxide (20% aqueous solution): 3.0 g
Ammonium sulfite: 3.0 g
Fluorescent brightening agent (4,4'-diaminostilbenedisulfonic acid derivative): 1.5 g
Water was added to reach a total quantity of 1 l, and pH was adjusted to 7.0 with sulfuric acid or potassium hydroxide.

The dye images obtained by the developing process described above were subjected to densitometry with respect to blue density using a PDA-65 densitometer, produced by Konica Corporation, and sensitivity and fog were determined. Sensitivity is expressed in values relative to that obtained from sample No. 101.

TABLE 2

| | Blue-sensitive layer | | | Blue-sensitive layer | |
|---|---|---|---|---|---|
| Sample number | Emulsion | Sensitizing dye | Cyan coupler | Sensitivity | Fog |
| 101 (Comparative) | Em-4B' | (I-3) | III-4 | 100 | 0.12 |
| 102 (Comparative) | Em-4B* | (II-2) | III-4 | 116 | 0.11 |
| 103 (Comparative) | Em-4B | (I-3) (II-2) | III-4 | 124 | 0.12 |
| 104 (Comparative) | Em-4B' | (I-3) | CC-1 | 100 | 0.12 |
| 105 | Em-4B" | (II-2) | CC-1 | 116 | 0.10 |

TABLE 2-continued

| Sample number | Blue-sensitive layer Emulsion | Sensitizing dye | Cyan coupler | Blue-sensitive layer Sensitivity | Fog |
|---|---|---|---|---|---|
| (Comparative) 106 | Em-4B | (I-3) (II-2) | CC-1 | 126 | 0.12 |
| (Comparative) 107 | Em-1B' | (I-3) | III-4 | 120 | 0.07 |
| (Comparative) 108 | Em-1B'' | (II-2) | III-4 | 93 | 0.08 |
| (Comparative) 109 | Em-1B | (I-3) (II-2) | III-4 | 120 | 0.07 |
| (Inventive) 110 | Em-1B' | (I-3) | CC-1 | 121 | 0.07 |
| (Comparative) 111 | Em-1B'' | (II-2) | CC-1 | 94 | 0.08 |
| (Comparative) 112 | Em-1B | (I-3) (II-2) | CC-1 | 122 | 0.07 |
| (Comparative) | | | | | |

From Table 2, it is evident that the emulsions having a high silver bromide content (Em-4B through Em-4B'') show high sensitivity provided by sensitizing dye II-2 and the sensitivity is increased by use of another sensitizing dye in combination, that the silver halide emulsions (Em-1B through Em-1'') of the present invention show high sensitivity provided by sensitizing dye I-3 and the sensitivity is maintained or slightly increased by use of another sensitizing dye in combination, that emulsions having a high silver bromide content show high fogging irrespective of the type of sensitizing dye, and that a high chloride content silver halide emulsion spectrally sensitized with sensitizing dye I-3 provides a high-sensitivity and low-fogging property irrespective of the type of cyan coupler used.

Then, to evaluate color reproduction quality, a negative film was prepared by taking a picture of a Macbeth color checker by a standard method (light source color was changed with a Wratten color compensating filter, produced by Kodak, attached to the lens).

Using a Konica color printer 7N3 model, set up by a standard method at the commencement of color print preparation, a color print was prepared from the negative film described above, and subjected to densitometry to evaluate color balance in the portion corresponding to neutral 5 on the Macbeth color checker.

Figure 1:
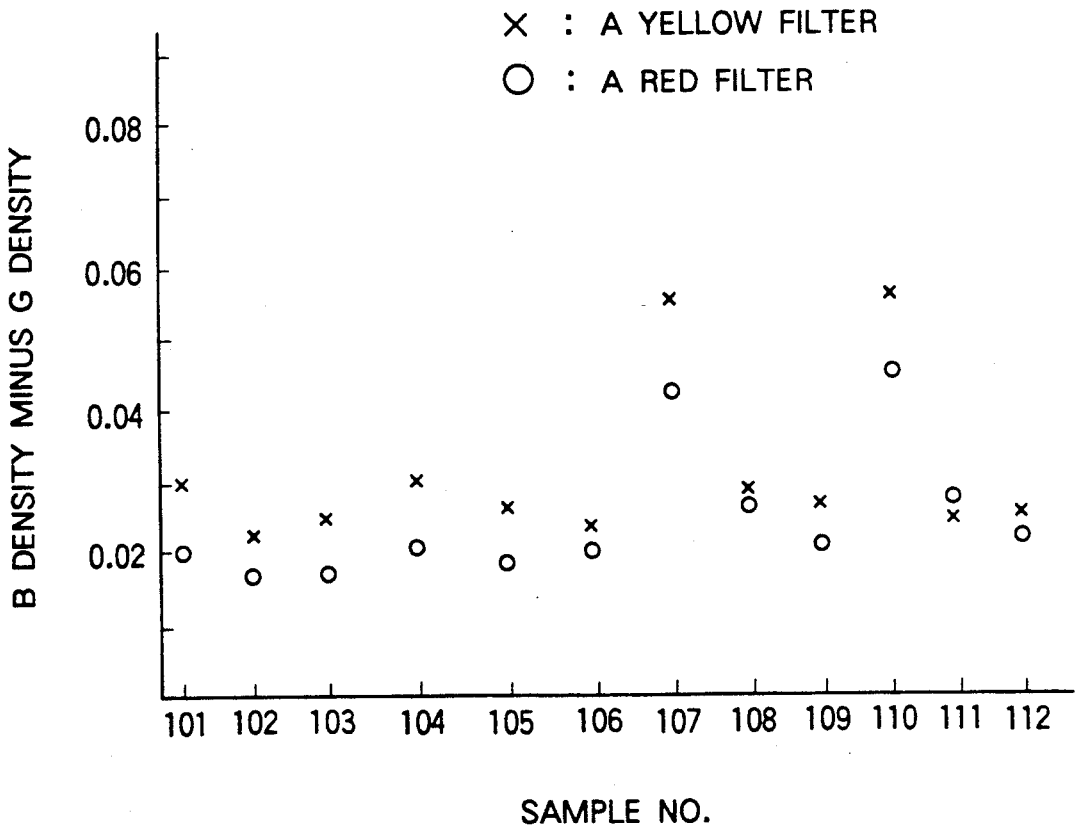
FIG. 1 shows the color density balance value obtained by densitometry of the color reproduced in the neutral 5 portion on Macbeth color checker in processed samples obtained in Example 1 with reference to G density, expressed in values relative to the value for a print obtained with a negative film obtained by picture taking without filter. The ordinate indicates the value of blue density minus green density balance. The abscissa indicates sample number.

The results are shown in FIG. 1. The figures are expressed in values relative to the print density balance from a negative film obtained by picture taking without filter. Here is shown in terms of the difference between green density and B density (B density-G density). It is seen that great changes occurred in samples 107 and 110, wherein high chloride content silver halide emulsion were spectrally sensitized with sensitizing dye I-3.

FIG. 2 shows with respect to green color reproductions on the Macbeth color checker. It is seen that the reproduced color is blueish in sample Nos. 101 through 106 in comparison with samples 107 through 112. Among the samples 107 through 112, sample Nos. 108 and 111 are low in chromaticness. Sample No. 107 is preferable because chromaticness increased noticeably, though a slight color hue discrepancy occurred. With respect to green color reproduction, sample Nos. 107, 109 and 110 are judged to be excellent.

As stated above, it is evident that color fluctuations and green color reproduction upon printing are both satisfied by the silver halide color photographic light-sensitive material of the present invention when they are compared at the same time.

Also, the effect of the present invention was confirmed in the color paper prepared using in place of Em-1 a silver bromochloride emulsion having a silver chloride content of 82 mol% prepared in the same manner as with Em-1.

EXAMPLE 2

Blue-sensitive emulsions were prepared using Em-1 in the same manner as in Example 1 except that the blue sensitizing dye was changed. Using these emulsions, color papers were prepared and evaluated in the same manner as in Example 1, except that cyan coupler III-4 was used.

The results are shown in Table 3.

TABLE 3

| Sample number | Blue-sensitizing dye* (mol/mol AgX) | Blue-sensitive layer Sensitivity | Fog | (in the case of yellow filter (B density − G density |
|---|---|---|---|---|
| 201 (Comparative) | (I-2) $5 \times 10^{-4}$ | 100 | 0.07 | 0.073 |
| 202 (Comparative) | (I-6) $5 \times 10^{-4}$ | 95 | 0.08 | 0.059 |
| 203 (Comparative) | (I-7) $5 \times 10^{-4}$ | 107 | 0.07 | 0.052 |
| 204 (Comparative) | (II-1) $5 \times 10^{-4}$ | 81 | 0.07 | 0.042 |
| 205 (Comparative) | (II-4) $5 \times 10^{-4}$ | 115 | 0.07 | 0.037 |
| 206 (Inventive) | (I-3) (II-1) $3 \times 10^{-4}$ $2 \times 10^{-4}$ | 96 | 0.08 | 0.025 |
| 207 (Inventive) | (I-3) (II-4) $4 \times 10^{-4}$ $1 \times 10^{-4}$ | 103 | 0.07 | 0.030 |
| 208 (Inventive) | (I-2) (II-2) $4 \times 10^{-4}$ $1 \times 10^{-4}$ | 105 | 0.07 | 0.029 |
| 209 (Inventive) | (I-7) (II-2) $4 \times 10^{-4}$ $1 \times 10^{-4}$ | 100 | 0.08 | 0.027 |
| 210 (Inventive) | (I-7) (II-2) $4 \times 10^{-4}$ $1 \times 10^{-4}$ | 110 | 0.09 | 0.024 |
| 211 (Inventive) | (I-6) (II-1) $3 \times 10^{-4}$ $2 \times 10^{-4}$ | 95 | 0.08 | 0.031 |
| 212 (Inventive) | (I-7) (II-4) $4 \times 10^{-4}$ $1 \times 10^{-4}$ | 101 | 0.07 | 0.030 |
| 213 (Inventive) | (I-3) (II-2) $2 \times 10^{-4}$ $3 \times 10^{-4}$ | 140 | 0.07 | 0.019 |
| 214 (Inventive) | (I-3) (II-2) $2.5 \times 10^{-4}$ $2.5 \times 10^{-4}$ | 135 | 0.07 | 0.021 |
| 215 (Inventive) | (I-3) (II-2) $3.5 \times 10^{-4}$ $1.5 \times 10^{-4}$ | 120 | 0.07 | 0.023 |
| 216 (Inventive) | (I-3) (II-2) $4.5 \times 10^{-4}$ $0.5 \times 10^{-4}$ | 115 | 0.07 | 0.029 |

TABLE 3-continued

| Sample number | Blue-sensitizing dye* (mol/mol AgX) | Blue-sensitive layer Sensitivity | Fog | (in the case of yellow filter (B density − G density |
|---|---|---|---|---|
| 217 (Inventive) | (I-3) (II-5) $2 \times 10^{-4}$ $3 \times 10^{-4}$ | 154 | 0.07 | 0.019 |
| 218 (Inventive) | (I-3) (II-5) $2.5 \times 10^{-4}$ $2.5 \times 10^{-4}$ | 143 | 0.06 | 0.019 |
| 219 (Inventive) | (I-3) (II-5) $3.5 \times 10^{-4}$ $1.5 \times 10^{-4}$ | 130 | 0.07 | 0.021 |
| 220 (Inventive) | (I-3) (II-5) $4.5 \times 10^{-4}$ $0.5 \times 10^{-4}$ | 119 | 0.07 | 0.024 |
| 221 (Inventive) | (I-7) (II-5) $3.5 \times 10^{-4}$ $1.5 \times 10^{-4}$ | 121 | 0.07 | 0.026 |

*mol/mol AgX

It is evident that a color paper showing small changes in print density due to variation of light source at picture-taking can be obtained by using a combination of sensitizing dyes of the present invention. These samples were evaluated as to green color reproduction (FIG. 3). A bluish color was reproduced in sample Nos. 201 through 205, with noticeable lightness reduction noted in sample No. 204, while excellent green reproduction was obtained in sample Nos. 206 through 221. Use of a sensitizing dye having a chlorine atom or a methoxy group at 5-position in the benzothiazole ring as in II-2 and II-5 is preferred because it offers excellent green color reproducibility. The same evaluation was carried out of combinations of I-1, I-5, I-9, I-11 and II-3, II-7, II-9 and II-11. It was confirmed that there are little changes in print density and excellent green reproduction is obtained with every combination.

EXAMPLE 3

A color paper was prepared in the same manner as in Example 1 except that the cyan coupler was changed as shown below. This color paper was processed and evaluated in the same manner as in Example 1 except that blue-sensitive emulsion Em-1 was used.

| Sample number | Cyan coupler | |
|---|---|---|
| 301 (comparative) | CC-1 | $8.5 \times 10^{-4}$ mol/m$^2$ |
| 302 (comparative) | CC-8 | $8.5 \times 10^{-4}$ mol/m$^2$ |
| 303 (inventive) | III-15 | $8.5 \times 10^{-4}$ mol/m$^2$ |
| 304 (inventive) | III-19 | $8.5 \times 10^{-4}$ mol/m$^2$ |
| 305 (inventive) | III-4, CC-1 | $4.5 \times 10^{-4}$, $4.0 \times 10^{-4}$ |
| 306 (inventive) | III-4, CC-8 | $4.5 \times 10^{-4}$, $4.0 \times 10^{-4}$ |
| 307 (inventive) | III-4, CC-6 | $4.5 \times 10^{-4}$, $4.0 \times 10^{-4}$ |
| 308 (inventive) | III-4, III-6 | $4.5 \times 10^{-4}$, $4.0 \times 10^{-4}$ |

The comparative results of green color reproduction are shown in FIG. 4. The samples prepared using a cyan coupler of the present invention showed excellent green color reproduction. Also, it is seen that excellent reproduction is obtained in sample Nos. 305 through 307 using another cyan coupler in combination.

Similarly, color reproduction quality was evaluated for samples prepared using couplers III-8, III-9, III-12, III-14, III-16 and III-17. It was found that these couplers offer favorable green reproduction when used in combinations of a blue-sensitive silver halide emulsion of the present invention, i.e., the effect of the present invention was confirmed.

Dispersions were prepared using dibutyl phthalate, dinonyl phthalate or tricresyl phosphate as a high-boiling organic solvent to disperse the cyan coupler, and color papers were prepared. The effect of the present invention was confirmed in all samples. Particularly, dinonyl phthalate, like dioctyl phthalate, was found to offer excellent color reproduction.

What is claimed is:

1. A silver halide photographic light-sensitive material comprising a support having thereon a yellow coupler-containing silver halide emulsion layer, a magenta coupler-containing silver halide emulsion layer and a cyan coupler-containing silver halide emulsion layer, wherein at least said yellow coupler-containing silver halide emulsion layer contains silver halide grains having a silver chloride content of not less than 80 mol %, a sensitizing dye represented by Formula I and a sensitizing dye represented by Formula II; and said cyan coupler-containing silver halide emulsion layer contains a cyan coupler represented by Formula III:

Formula I

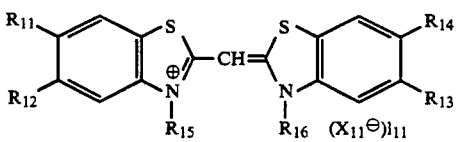

wherein $R_{11}$, $R_{12}$, $R_{13}$, and $R_{14}$ each represent a hydrogen atom, a halogen atom, and alkyl group, an alkoxy group, an aryl group or a hydroxy group; $R_{15}$ and $R_{16}$ each represent an alkyl group; $X_{11}^{\ominus}$ represents and anion and $l_{11}$ represents 0 or 1;

Formula II

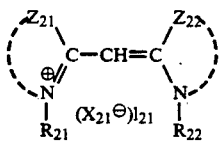

wherein $Z_{21}$ and $Z_{22}$ each represent a group of atoms necessary for forming a benzothiazole nucleus, a benzoselenazole nucleus, a naphthothiazole nucleus or a naphthoselenazole nucleus, at least one of which is a naphthothiazole or naphthoselenazole nucleus; $R_{21}$ and $R_{22}$ ⊖ each represent an alkyl group, an alkenyl group or an aryl group; $X_{21}$ represents an anion an $l_{21}$ represents 0 or 1;

Formula III

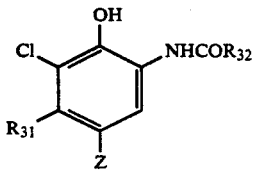

wherein $R_{31}$ represents and alkyl group having a carbon number of 2 to 6; $R_{32}$ represents a ballast group and Z represents an hydrogen atom, or an atom or a group capable of being split off from reaction with the oxidation product of a color developing agent.

2. A silver halide photographic light-sensitive material of claim 1, wherein said silver halide grains comprise silver bromochloride having a silver bromide content of 0.1 to 2 mol %.

3. A silver halide photographic light-sensitive material of claim 1, wherein at least one of the groups represented by $R_{11}$, $R_{12}$, $R_{13}$ and $R_{14}$ in the Formula I is a chlorine atom.

4. A silver halide photographic light-sensitive material of claim 3, wherein two of $R_{11}$ to $R_{14}$ are chlorine atoms.

5. A silver halide photographic light-sensitive material of claim 1, wherein $R_{15}$ and $R_{16}$ in the Formula I each represent a sulfoalkyl group or carboxyalkyl group having a carbon number of 1 to 4.

6. A silver halide photographic light-sensitive material of claim 1, wherein the benzothiazole, benzoselenazole, naphthothizole or naphthoselenazole nucleus formed by $Z_{21}$ and $Z_{22}$ in the Formula II has a substituent group of a halogen atom, a hydroxy group, an aryl group, an alkyl group or an alkoxy group.

7. A silver halide photographic light-sensitive material of claim 6, wherein said substituent group is a chlorine atom, a phenyl group, a methyl group or a methoxy group.

8. A silver halide photographic light-sensitive material of claim 1, wherein $R_{21}$ and $R_{22}$ in the Formula II each represent a sulfoalkyl group or a carboxyalkyl group.

9. A silver halide photographic light-sensitive material of claim 1, wherein the dyes represented by the Formula I and II are contained in a molar ratio of I to II between 1:1 and 20:1.

10. A silver halide photographic light-sensitive material of claim 1, wherein the dyes represented by the Formula I and II are contained in a molar ratio of I to II between 1:1 and 10:1.

11. A silver halide photographic light-sensitive material of claim 9, wherein said dyes are contained in a total amount of $5\times10^{-5}$ to $2\times10^{-3}$ mol per mol silver halide.

12. A silver halide photographic light-sensitive material of claim 10, wherein said dyes are contained in a total amount of $1\times10^{-4}$ to $7\times10^{-4}$ mol per mol silver halide.

13. A silver halide photographic light-sensitive material of claim 1, wherein $R_{32}$, in the Formula III is represented by the following formula:

$$-\underset{\underset{R_{33}}{|}}{CH}-O-Ar$$

wherein $R_{33}$ represents an alkyl group having a carbon number of 1 to 12; Ar represents an aryl group, which may be substituted or unsubstituted.

14. A method of forming a color image comprising a process of exposing color paper by the use of a printer based on the system wherein the amount of printing exposure is determined by measuring the density of a color negative film, wherein said color paper is a silver halide photographic light. sensitive material as claimed in claim 1.

* * * * *

UNITED STATES PATENT AND TRADEMARK OFFICE

CERTIFICATE OF CORRECTION

PATENT NO. : 5,081,006

DATED : Shigeo Tanaka et al.

INVENTOR(S) : January 14, 1992

It is certified that error appears in the above-identified patent and that said Letters Patent is hereby corrected as shown below:

Claim 1, column 32, line 42, after "represents" change "and" to --an--.

Claim 1, column 32, line 57, change "$R_{22}$°" to --$R_{22}$--.

Claim 1, column 32, line 58, change "$X_{21}$" to --$X_{21}$°--.

Claim 1, column 33, line 1, change "and" to --an--.

Claim 6, column 33, line 24, change "naphthothizole" to --naphthothiazole--.

Claim 14, column 34, line 33, change "light.sensitive" to --light-sensitive--.

Signed and Sealed this

Seventeenth Day of August, 1993

Bruce Lehman

*Attest:*

BRUCE LEHMAN

*Attesting Officer*

*Commissioner of Patents and Trademarks*